US005851088A

United States Patent [19]

Anderson et al.

[11] Patent Number: 5,851,088

[45] Date of Patent: Dec. 22, 1998

[54] MODULAR RETAINING WALL BLOCK SYSTEM INCLUDING WALL BLOCKS HAVING REPLACEABLE DUAL PURPOSE FACING PANELS AND REMOVABLE SPACING TABS

[75] Inventors: Robert Anderson, Alpharetta; Gale Sanders, Peachtree City, both of Ga.; Robert Freund, Waynesville, Ohio

[73] Assignee: The Tensar Corporation, Atlanta, Ga.

[21] Appl. No.: 905,741

[22] Filed: Aug. 4, 1997

[51] Int. Cl.[6] ..... E02D 3/02; E02D 5/18; E02D 29/00

[52] U.S. Cl. ..... 405/284; 405/258; 405/262

[58] Field of Search ..... 405/262, 284, 405/285, 286, 273, 258; 52/591.1, 597, 598, 570, 604

[56] References Cited

U.S. PATENT DOCUMENTS

| | | | |
|---|---|---|---|
| 770,844 | 9/1904 | Church . | |
| 1,349,166 | 8/1920 | Paff . | |
| 1,356,319 | 10/1920 | Smulski | 405/286 |
| 1,663,453 | 9/1928 | Coke-Hill . | |
| 3,421,326 | 1/1969 | Vidal . | |
| 4,374,798 | 2/1983 | Mercer . | |
| 4,379,659 | 4/1983 | Steiner . | |
| 4,470,728 | 9/1984 | Broadbent . | |
| 4,521,138 | 6/1985 | Steiner . | |
| 4,530,622 | 7/1985 | Mercer . | |
| 4,661,023 | 4/1987 | Hilfiker . | |
| 4,668,129 | 5/1987 | Babcock et al. . | |
| 4,671,706 | 6/1987 | Giardini . | |
| 4,684,294 | 8/1987 | O'Neill . | |
| 4,728,227 | 3/1988 | Wilson et al. . | |
| 4,804,299 | 2/1989 | Forte et al. . | |
| 4,884,921 | 12/1989 | Smith . | |
| 4,920,712 | 5/1990 | Dean, Jr. . | |
| 5,044,834 | 9/1991 | Janopaul, Jr. . | |
| 5,066,169 | 11/1991 | Gavin et al. . | |
| 5,114,270 | 5/1992 | Riddle . | |
| 5,156,496 | 10/1992 | Vidal et al. . | |
| 5,177,925 | 1/1993 | Winkler et al. . | |
| 5,214,898 | 6/1993 | Beretta . | |
| 5,224,801 | 7/1993 | Quaney . | |
| 5,282,700 | 2/1994 | Rodrique . | |
| 5,320,455 | 6/1994 | Mattox . | |
| 5,337,527 | 8/1994 | Wagenaar . | |
| 5,417,523 | 5/1995 | Scales . | |
| 5,489,165 | 2/1996 | Smith | 405/284 |
| 5,568,999 | 10/1996 | Egan et al. . | |

FOREIGN PATENT DOCUMENTS

| | | |
|---|---|---|
| 00798805 | 4/1983 | European Pat. Off. . |
| 481435 | 9/1920 | France . |

OTHER PUBLICATIONS

General Electric, "The Handbook of Engineering Structural Foam", Jan. 1978, Cover, pp. 4–7, and Back Cover.

"Tensar® Concrete GeoWall Package" Brochure, 1987.

*Primary Examiner*—Tamara L. Graysay
*Assistant Examiner*—Jong-Suk Lee
*Attorney, Agent, or Firm*—Jacobson, Price, Holman & Stern, PLLC

[57] ABSTRACT

A modular plastic wall block to be used for forming a retaining wall including a plurality of vertically superimposed courses, each course including a plurality of laterally juxtaposed wall blocks. Each wall block is formed of a wall block frame and an easily replaceable facing panel interconnected by a tongue and groove connection. By rotating the facing panel by 90°, it can be used to overly and conceal at least a portion of the top of an uppermost course of wall blocks in the retaining wall. The wall blocks include elements for side-to-side connection enabling juxtaposed wall blocks in each course to be laterally aligned to form a straight portion of a face of a retaining wall, or to be angularly positioned to form concave or convex portions of the face of the retaining wall without the formation of gaps between adjacent wall blocks. Spacing tabs are removably carried by each wall block to enable the user to selectively adjust the spacing between the point of engagement between superimposed wall blocks and the front faces of the block below for the formation of vertical or stepped back retaining wall faces.

52 Claims, 9 Drawing Sheets

5.059
4.559
3.648
3.149
2.197
11.25°
26
78
130
40
22
46
48
66
70a
60
70b
54
R 0.875
140
20
32
R 1.375
142
138
36
34
56
50
52
38
136
132
1.988
3.925
11.870
2.469
2.754
64
0.997
1.127
0.497
58
24
30
68b
68a
28
76
74
0.994
1.224
2.247
3.498
8.750

MODULAR RETAINING WALL BLOCK SYSTEM INCLUDING WALL BLOCKS HAVING REPLACEABLE DUAL PURPOSE FACING PANELS AND REMOVABLE SPACING TABS

FIELD OF THE INVENTION

This invention relates to a retaining wall block system and more particularly, to a plastic wall block comprising a frame adapted to receive a replaceable facing panel member which can also be used as a cap unit for the uppermost course of a plurality of courses of wall blocks forming a retaining wall. Removable spacing tabs are integrally formed with each wall block for adjusting the dimensional relationship of the top-to-bottom engaging means between blocks in superimposed courses to enable the user to selectively arrange the front faces of successive courses in either a vertically aligned or vertically set-back orientation. The side-to-side engaging means between juxtaposed blocks in a single course of blocks according to this invention is designed to permit the formation of retaining walls having straight, convex and/or concave facing portions without gaps therebetween.

BACKGROUND OF THE INVENTION

Retaining walls are commonly used for architectural and site development applications. Particularly for higher retaining walls, the wall facing must withstand significant pressure exerted by backfill soil or other aggregate. Reinforcement and stabilization of the backfill in such walls is commonly provided by grid-like sheet materials that are placed in layers in the fill material behind the wall face to interlock with the fill and create a stable reinforced mass. Connection of the reinforcing material to the elements forming the retaining wall holds the wall elements in place and resists backfill pressures.

One form of grid-like tie back sheet material used to reinforce the fill material behind such retaining wall structures may desirably be a uniaxially or biaxially oriented integral structural geogrid of the type which is commercially available from The Tensar Corporation of Morrow, Ga. ("Tensar") and is made by the process disclosed in U.S. Pat. No. 4,374,798 ("the '798 patent"), the subject matter of which is incorporated herein in its entirety by reference. However, other forms of grid-like tie-back sheet materials have also been used as reinforcing means in the construction of retaining walls, and the instant inventive concepts are equally applicable with the use of such materials.

In a brochure entitled "Concrete Geowall Package", published by Tensar in 1986, various retaining wall structures are shown using full height cast concrete panels. In one such retaining wall structure short strips, or tabs, of geogrid material are embedded in the cast wall panels. On site, longer strips of geogrid used to reinforce the wall fill and create a stable mass are connected to the tabs by passing a rod through loops formed by interleaving the strands of the geogrid sections, a connection sometimes referred to as a "Bodkin" joint.

Use of full height pre-cast concrete wall panels for wall facing elements in a retaining wall requires heavy equipment because the panels are very large and quite heavy, such that they cannot be readily manhandled. To avoid such problems, other types of retaining wall structures have been developed including walls formed from cementitious modular wall blocks which are typically relatively small by comparison and can be arranged in a plurality of single individual superimposed courses, much like laying of brick or the like, by a single individual.

Because of the high-speed method of forming cementitious wall blocks, it is not practical to embed tabs of geogrid or the like in the blocks for attachment to grid-like reinforcing sheets by a Bodkin-type connection as in the cast concrete panels. Therefore, other means for securing reinforcing grid to selected concrete modular blocks in the construction of a retaining wall were devised. Some techniques engage end portions of the reinforcing sheets between layers of wall blocks, relying primarily on the weight and engagement of large surfaces of the superimposed blocks to secure the grid; however, the very rough cementitious surfaces tends to abrade, and thereby weaken, the polymeric sheet material at the very point of interconnection. Other techniques rely on pins, staples or comb-like elements to capture the geogrid and minimize these problems. Preferred constructions are seen in U.S. Pat. Nos. 5,540,525, 5,595,460 and others assigned to Tensar, the subject matter of each of which is incorporated herein in its entirety by reference.

Although such cementitious wall blocks are individually lighter and easier to manufacture and use than full height, pre-cast concrete wall panels, they are still fairly expensive and relatively heavy, malding them cumbersome and inconvenient, particularly for use in constructing relatively low retaining walls such as are commonly found in home landscaping. Additionally, the nature of the materials used in the production of such prior art modular wall blocks limits the versatility in design and aesthetic presentation in the finished product.

A relatively simple and inexpensive wall block system usable by a consumer to readily erect a retaining wall is described in U.S. Pat. No. 5,568,999, assigned to Tensar, and hereby incorporated by reference in its entirety. In the '999 patent, the wall blocks are formed of plastic or other light-weight, easily molded materials and may be laid in a plurality of superimposed courses, with the blocks in each course laterally staggered relative to the blocks above and below. The individual wall blocks of the '999 patent include a plurality of fingers to capture end portions of extended lengths of geogrid or the like, if it is necessary to reinforce the fill material supporting the retaining wall.

The plastic wall block of the '999 patent may be molded of structural foam or the like as an integral product with a vertically extending member, the front of which may comprise any desired configuration to form a portion of the facing of the retaining wall. A generally horizontal bottom member or base extends rearwardly from the lowermost edge of the front member, and a somewhat shorter top member extends rearwardly from the uppermost edge. To integrate superimposed blocks top-to-bottom, the bottom member of each wall block in the '999 patent is provided with downwardly and forwardly extending hooks adapted to engage the top members of a pair of staggered underlying juxtaposed blocks in a lower course. The hooks are positioned and dimensioned to rearwardly shift blocks relatively to the course below, thereby vertically offsetting the front faces of superimposed courses in the resultant retaining wall. By changing the dimensional relationship of the elements, wall blocks can be provided which produce a retaining wall with the front faces of superimposed courses vertically aligned. However, the wall blocks of the '999 patent cannot be adapted by the user to enable the front faces of superimposed courses in the retaining wall to be selectively vertically aligned or offset using the same block. This necessitates the production of different blocks for specific applications, creating additional expense in manufacture and inventory.

As a related problem, no specific provision is made for a cap unit or cover for the uppermost course of blocks to provide the retaining wall with an aesthetically attractive appearance. Since the plastic wall block system of the '999 patent is particularly adapted for home landscaping, a finished look is obviously a desirable feature. With the '999 system, a separate and unique cap unit would be necessary, even further exacerbating the manufacturing and inventory costs.

Another limitation in the design of the plastic wall blocks of the '999 patent resides in the side-to-side engagement of blocks in the same course. Each block of the '999 patent includes a short sidewall extending rearwardly at right angles to the front face. On one side, the side wall is provided with a vertically extending, outwardly projecting lip defining a forwardly facing arcuate surface while the opposite side wall of each block includes a recess. The bottom edge of the lip of one block rests on the bottom edge of the recess of a juxtaposed block and the arcuate surface of the lip receives the vertical edge of the recess when adjacent wall blocks in a course of wall blocks are interengaged.

The top and bottom members of the blocks converge inwardly and rearwardly from the sides edges of the front face. The arcuate nature of the lip on the side of the wall block, in combination with the converging top and bottom members, facilitate the construction of a curved retaining wall from the blocks. However, to some extent, the top-to-bottom interconnecting means of the '999 patent interferes with the formation of an arcuate wall portion. Moreover, in order to form a retaining wall where the front facing defines a convex curve with the blocks of the '999 patent, because the sidewalls extend perpendicularly to the front wall, small gaps are formed between juxtaposed blocks in each course, further diminishing the structural integrity and aesthetic appearance of the resultant wall. The provision of a modular wall block with top-to-bottom and side-to-side engagement means that permit the formation of a course of straight, concave and/or convex portions without gaps between adjacent blocks would obviously be preferred.

Thus, it can be seen that the plastic wall block system of the '999 patent has many advantages over the use of cast concrete panels or cementitious modular wall blocks according to the prior art. However, several features of the patented system are less than perfect.

SUMMARY OF THE INVENTION

Accordingly, it is a primary object of the instant inventive concepts to provide a plastic wall block system which overcomes the aforementioned disadvantages of the '999 patented blocks, and incorporates highly versatile elements having multiple uses for different applications.

Consistent therewith, it is one object of this invention to provide a modular plastic retaining wall block with a facing panel which is removably attachable to portions of a wall block frame through a simple tongue-in-groove connection, enabling the facing panel to be readily replaced if damaged, or if a different pattern is desired on the face of a retaining wall to be formed from such blocks.

To even further enhance the versatility of the elements of the wall blocks of this invention, the facing panel is preferably designed to enable the same to be turned at 90° and received over the uppermost course of blocks in a retaining wall to form an aesthetically attractive cap unit therefor. When used in this fashion, the normally vertically extending facing portion will extend horizontally and at least partially cover the top blocks to provide the retaining wall with a finished appearance, without the need for a discrete or separately formed cap unit.

Thus, with this system, facing panels of infinite color and pattern variety may be readily attached to, and if desired, removed from, a wall block frame constructed in accordance with the principles of the present invention. Moreover, these same facing panels are adapted to function as cap units for the uppermost course of blocks in the retaining wall.

Another important object of this invention is the provision of a plastic wall block designed to selectively form retaining walls which may include straight, concavely curved or conversely curved sections, with the front facing portions of juxtaposed blocks in each course in direct contact with other, thereby providing a continuous retaining wall face regardless of the orientation of the blocks. To facilitate curving the wall, the top-to-bottom connection means of the wall blocks of this invention include abutting arcuate surfaces which provide point contact minimizing interference and enabling the wall blocks to be laterally staggered and more readily angled to form a concave or convex curvature to the retaining wall face.

Additionally, each of the sidewalls of the wall block of this invention follow the inward and rearward convergence of the bottom member of the wall block frame, rather than extending perpendicularly to the front face as in the '999 patent. One sidewall terminates at a free edge defining a flat surface, and the opposite side wall is provided with an outwardly projecting, arcuate lip terminating in a flange which extends from the curved surface back towards the front wall of the block frame.

In positioning adjacent blocks in a course of blocks, the free edge of a sidewall of one block engages the curved surface of the lip of an adjacent block. If desired, the front faces of the adjacent blocks can be aligned to form a straight portion of the retaining wall. However, by pivoting two adjacent blocks in a course of blocks with respect to each other, a concavely or convexly curved wall portion may be formed. By angling the blocks until the sidewalls contact each other, or one sidewall engages the flange on the arcuate lip of the adjacent block, curvatures ranging from, on the order of 22.5° to about 157.5°, for example, can be provided without the formation of gaps between juxtaposed blocks as in the '999 patent.

Yet a further object of this invention is to provide a simplified plastic wall block design which incorporates means to enable a user to readily modify the block for the selective construction of a retaining wall with vertically aligned or vertically stepped-back front face portions in superimposed courses. In this respect, each block, as molded, is designed to produce a retaining wall with a vertical face. However, removable spacing tabs are connected to the frame of each block by thin, frangible, bridging pieces. The depth of the grooves formed by the depending hooks which normally engage the top members of a pair of laterally staggered wall blocks in a lower course may be reduced when fitted with the spacing tabs, thereby selectively reducing the overlap between the courses, causing the upper wall blocks to be offset rearwardly, if desired.

Another object of the present invention to provide a plastic modular wall block of the type described including grid-engaging fingers extending upwardly from the bottom member for receiving and retaining sections of geogrid or other such tieback means if it is desired or necessary to reinforce the mass of fill material, such as soil, behind the retaining wall.

The above and other objects of the invention, as well as many of the attendant advantages thereof, will become more readily apparent when reference is made to the following detailed description, taken in conjunction with the accompanying drawings.

DETAILED DESCRIPTION OF THE PREFERRED EMBODIMENTS

Figure 1:
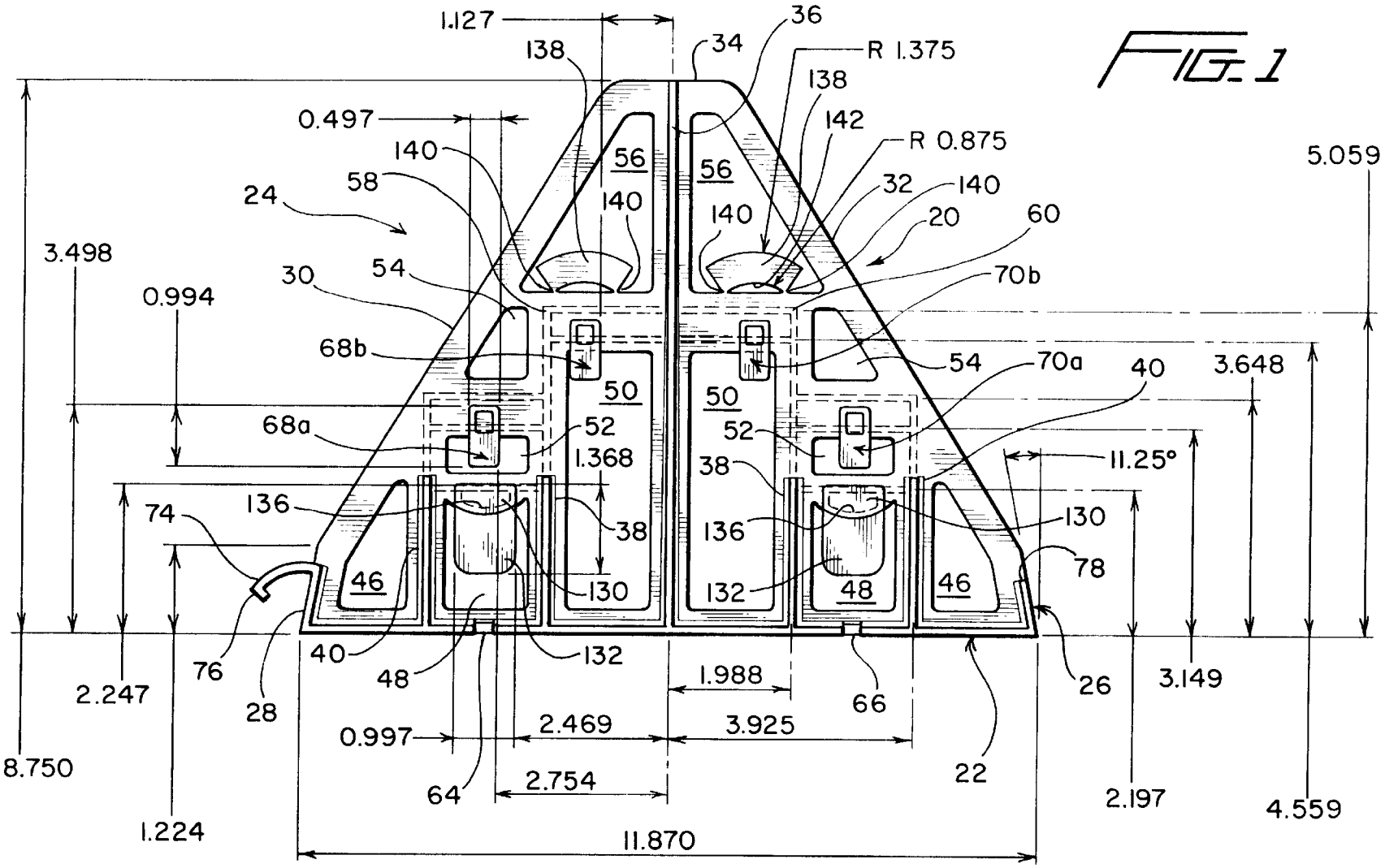
FIG. 1 is a top plan view of a preferred form of a plastic wall block frame according to the instant inventive concepts with dotted lines illustrative of surfaces concealed from view.

In describing a preferred embodiment of the invention illustrated in the drawings, specific terminology will be used for the sake of clarity. However, the invention is not intended to be limited to the specific terms so selected, and it is to be understood that each specific term includes all technical equivalents which operate in a similar manner to accomplish a similar purpose. Likewise, while preferred dimensions are set forth to describe the best mode currently known for the plastic wall block system of this invention, these dimensions are illustrative and not limiting on the instant inventive concepts.

For example, the illustrated dimensions are more appropriate for wall blocks to be used by the end consumer in the formation of retaining walls of limited scope. It is envisioned as being within the inventive concepts of the present invention to enlarge the scale of the depicted wall blocks for use in the construction of retaining walls of greater magnitude such as may be necessary for civil engineering structures.

Figure 2:
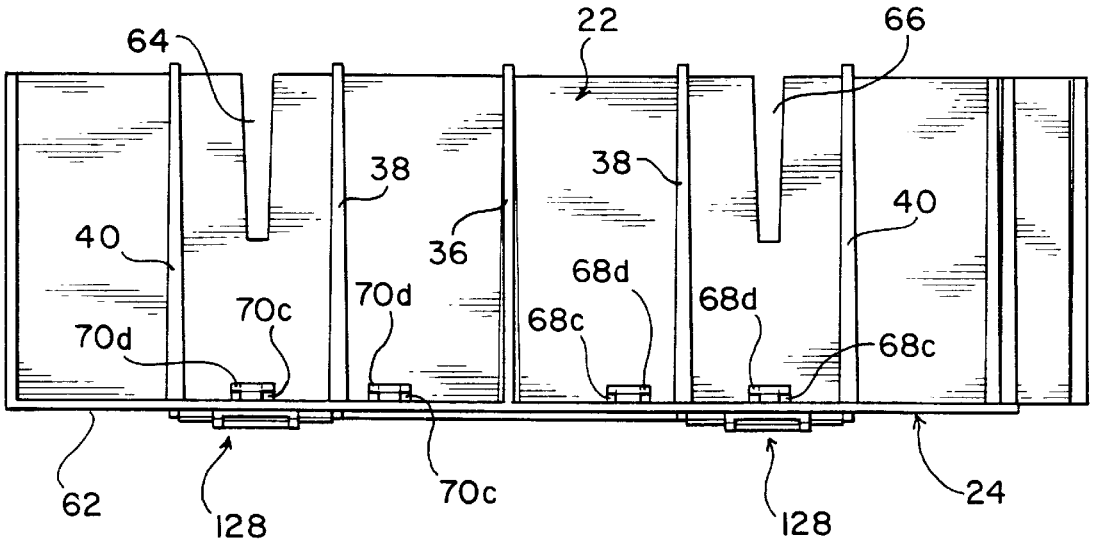
FIG. 2 is a rear view of the wall block frame of FIG. 1.
Figure 3:
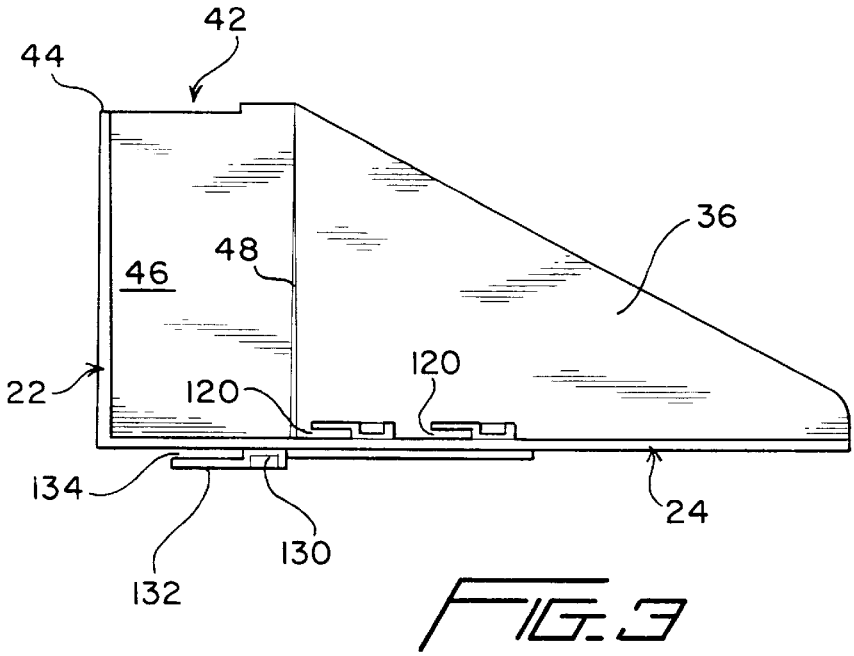
FIG. 3 is a right side elevational view of the wall block frame of FIG. 1.

With reference now to the drawings in general, and FIGS. 1 through 3 in particular, a preferred embodiment of a plastic wall block frame is schematically shown at 20 as comprising a front member 22, a bottom member 24 and short rearwardly extending, inwardly converging, sidewalls 26, 28 extending between the bottom member 24 and front member 22.

The side edges 30, 32 of the bottom member 24 taper inwardly from the front member 22 at an angle of approximately 80° for a distance slightly greater than the length of attachment of the sidewalls 26, 28, and then decreasing to an angle of taper of approximately 57.5° towards a rearmost edge 34 which extends substantially parallel to front member 22.

A plurality of reinforcement ribs may extend between the front member 22 and the bottom member 24. As illustrated, a central reinforcement rib 36 extends from the front member to rearmost edge 34 of bottom member and symmetrically spaced pairs of ribs 38, 40 extend the full height of the front member 22 partially towards the rear. A recess 42 extends rearwardly from the uppermost edge 44 of the front member 22 partially across the top of each of ribs 36, 38 and 40 to accommodate portions of a facing panel as described hereinbelow.

The bottom member 24 may be provided with a plurality of openings to minimize the plastic material, reduce the weight of the frame and facilitate the molding of undercut portions. In the illustrative embodiment, symmetrically spaced pairs of openings 46, 48, 50, 52, 54 and 56 are shown. Strengthening ribs, such as partially shown in dotted lines in FIG. 1 at 58, 60, may also be provided along the bottom surface 62 of the bottom member 24, if desired.

Projecting upwardly from the bottom member 24 are two pairs of grid-engaging fingers 68*a*, 68*b* and 70*a*, 70*b*. These fingers each include a vertically extending post section 68*c*, 70*c*, respectively, and a flat grid retaining portion 68*d*, 70*d*, respectively, extending parallel to the bottom member 24. The fingers 68*a*, 68*b* are located on one side of the central rib 36 and the fingers 70*a*, 70*b* are on the opposite side. In addition, fingers 68*a* and 70*a* are aligned laterally with respect to each other whereas fingers 68*b* and 70*b* are aligned laterally with respect to each other. The spacing of the fingers 68*a* and 68*b* as well as the spacing between fingers 78*a* and 70*b* are defined such that the fingers can fit within the openings of a grid-like sheet of reinforcing material. Accordingly, two adjacent wall blocks in a course of wall blocks will cooperate to capture end portions of an extended length of grid-like sheet of material between their respective reinforcement ribs 36. If wider sheets of reinforcing material are desired, they can be slit to preclude interference from the central ribs 36.

Figure 15:
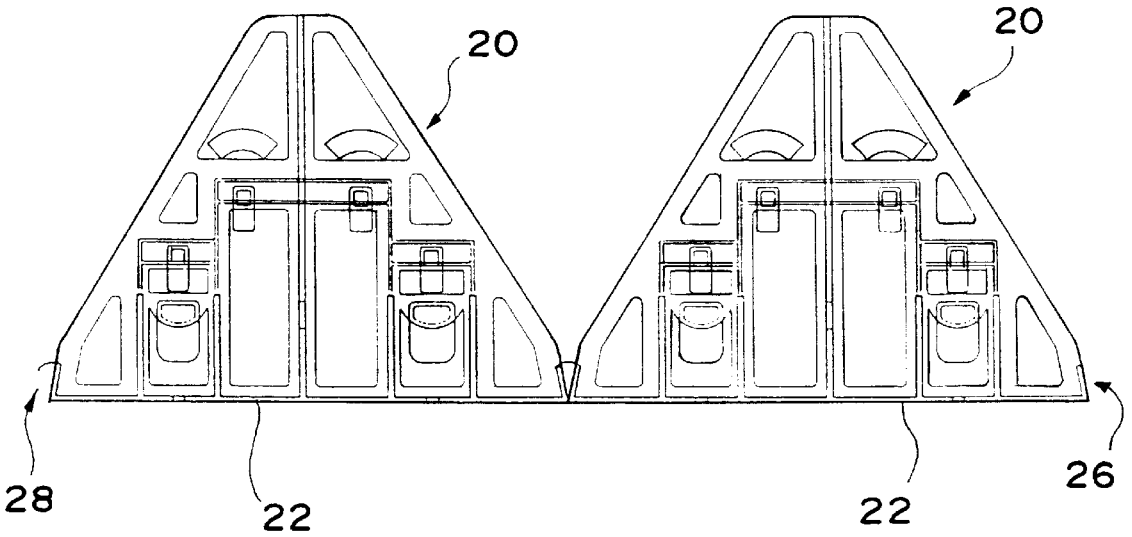
FIG. 15 illustrates the side-to-side interconnection of two adjacent wall blocks in the formation of a course of blocks with their front facing surfaces in a straight alignment.
Figure 16:
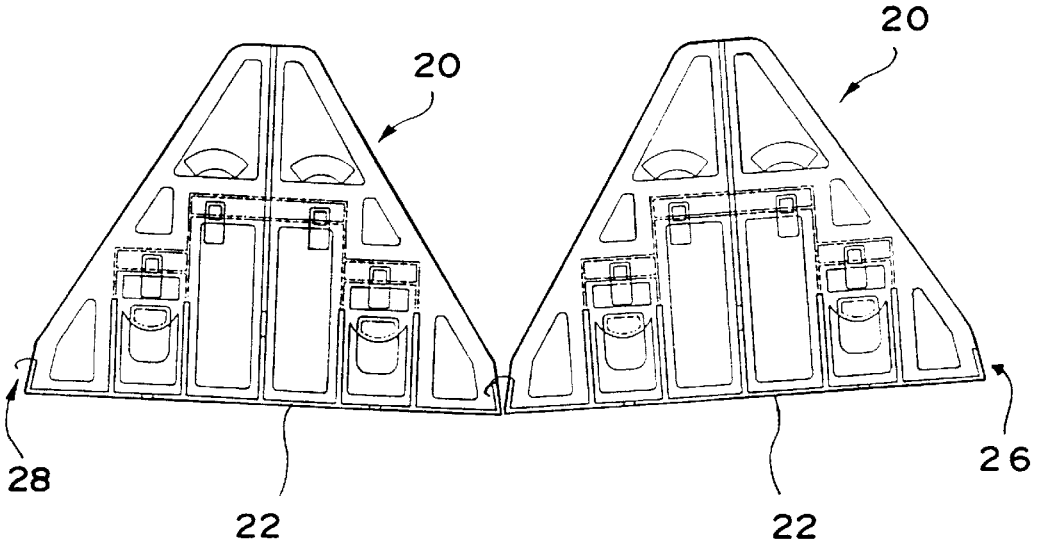
FIG. 16 is a view similar to FIG. 15 with adjacent blocks angled to form a slightly concaved front facing.
Figure 17:
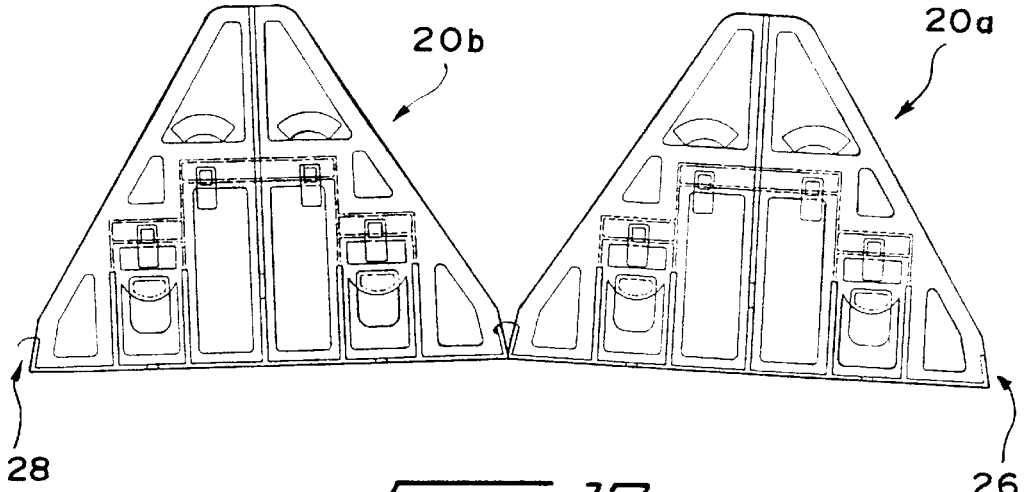
FIG. 17 illustrates the formation of a slightly convex front facing by a pair of adjacent wall blocks according to this invention.

Side-to-side interconnection and alignment of laterally adjacent wall blocks in each course is effected by the engagement of the edge 78 of sidewall 26 with the curved surface of the arcuate lip 74 on sidewall 28 which terminates in a stop or flange 76. These elements enable juxtaposed blocks to be engaged with their front members substantially aligned as shown in FIG. 15 or angled to produce a convex curvature as shown in FIG. 16 or a concave curvature as shown in FIG. 17. With the sidewalls 26, 28 converging as illustrated, and the stop 76 on the arcuate lip 74 angled as shown, the blocks in a single course can be curved from approximately 22.5° to about 157.5° with the edge portions of adjacent blocks in direct contact with each to preclude the formation of gaps between blocks in each course. The extent of curvature in one direction is limited by engagement of the outside of sidewall 26 with the outside of sidewall 28; in the other direction the extent of curvature is limited by engagement of the inside of sidewall 26 with flange 76 on the arcuate lip 74 of sidewall 28.

A pair of tapered grooves or keyways 64, 66 are formed on the front member 22 of the wall block frame for interconnection of the frame 20 with a facing panel 80 illustrated in detail in FIGS. 4 through 8. The facing panel 80 can be molded in any color, and the front surface or face 82 can be provided with any selected pattern. When the facing panel 80 is mounted on the wall block frame 20 as described below, the facing member 84 overlies and conceals the front member 22 of the frame and the facing surface 82 defines a portion of the front face of the retaining wall formed from a plurality of wall blocks according to this invention.

Figure 4:
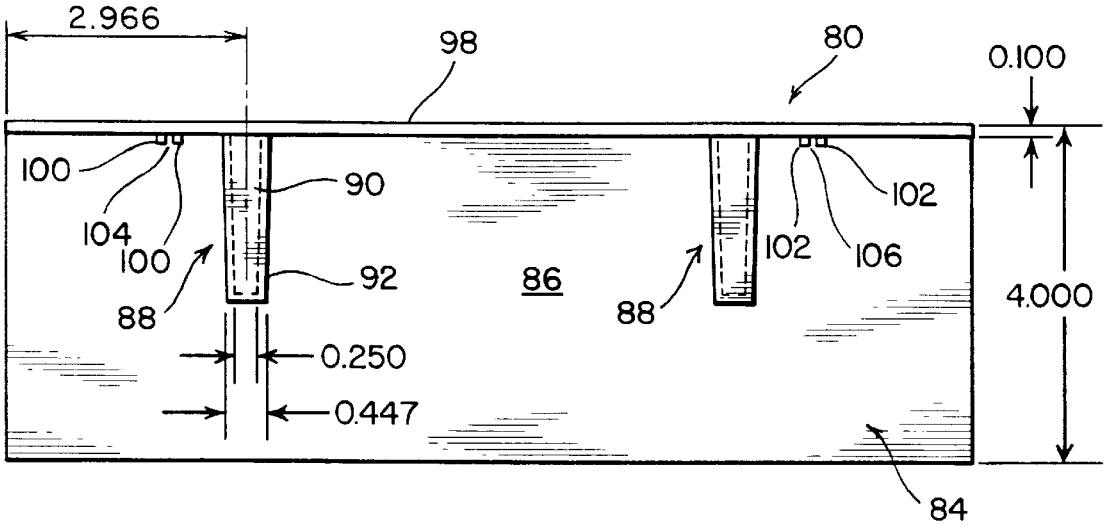
FIG. 4 is a rear view of a facing panel for use with the wall block frame of FIG. 1.
Figure 5:
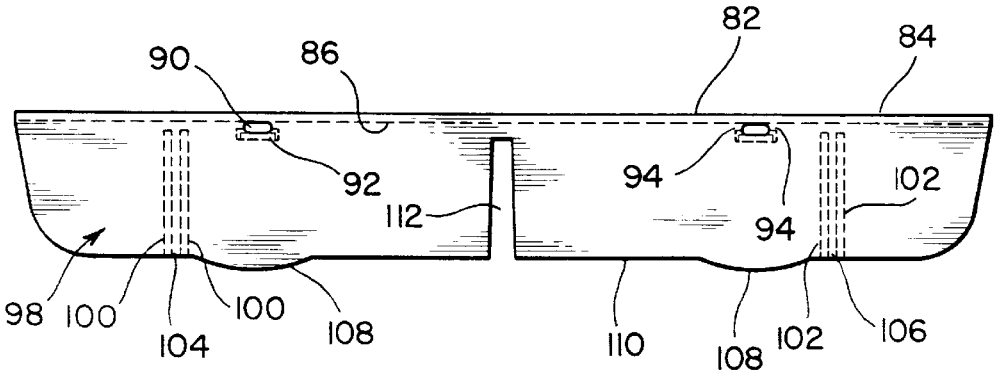
FIG. 5 is a plan view of the facing panel shown in FIG. 4.
Figure 6:
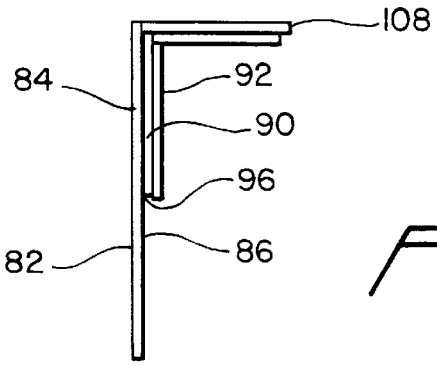
FIG. 6 is a right side elevational view of the facing panel of FIG. 4.

A pair of T-shaped tongues 88 are defined on the rear surface 86 of each facing panel 80. Each tongue includes a base or stem 90 extending from the surface 86 and supporting an elongated cross-bar or top portion 92. As shown in FIGS. 4–6, the top portion 92 projects beyond three sides of the base portion 90 so as to define two side recesses 94 and an end recess 96.

A top member 98 of the facing panel 80 extends substantially perpendicularly to the facing member 84, and is provided with two pairs of reinforcing ribs 100, 102 on its undersurface to define recesses 104, 106 therebetween, respectively. The top member 98 also includes two arcuate surfaces 108 projecting from a trailing edge 110, and a centrally located slot 112 for purposes to be described below.

Figure 7:
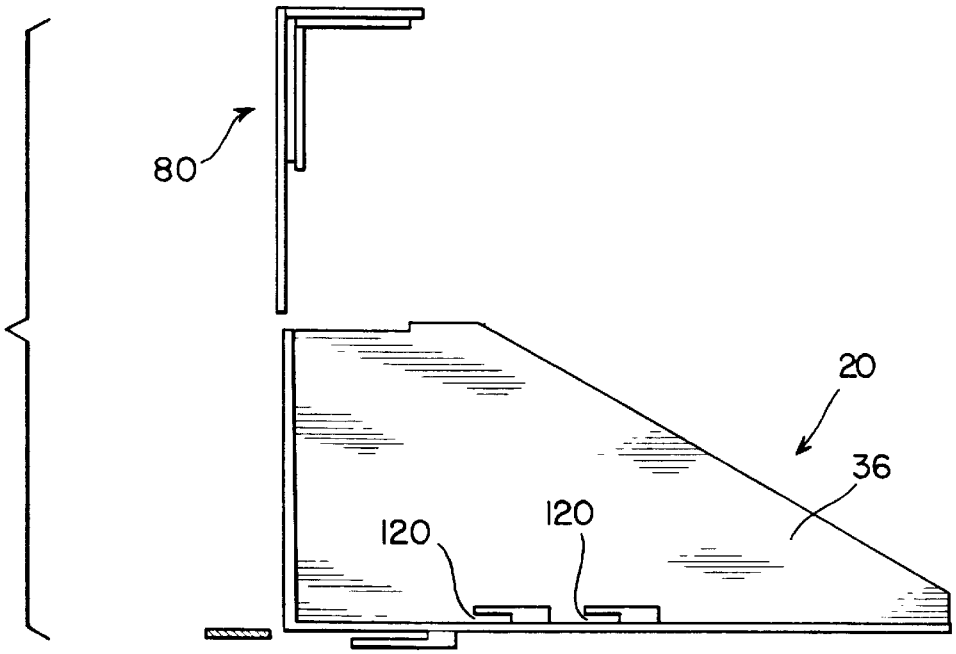
FIG. 7 is an exploded schematic view of a wall block frame, a facing panel and a spacing tab according to the instant inventive concepts.
Figure 8:
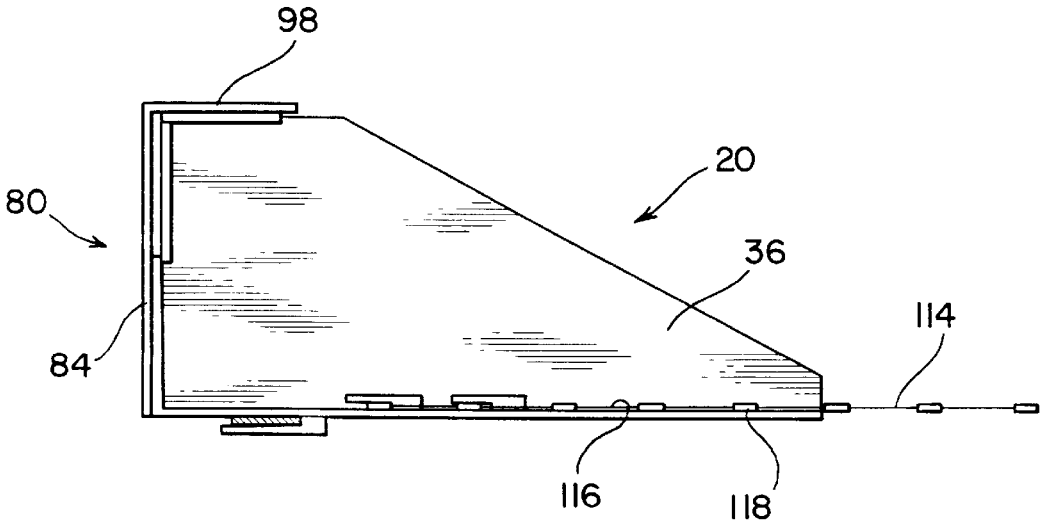
FIG. 8 illustrates an assembled view of the wall block frame and facing panel, with a spacing tab engaged with the frame to set-back the front faces of superimposed courses of wall blocks, and with end portions of an extended length of geogrid captured by grid engaging fingers on the wall block frame.

To attach a facing panel 80 to a wall block frame 20, the facing panel is initially positioned in the orientation shown in FIG. 7 with the facing member 84 extending vertically and the top member 98 positioned horizontally. The facing panel 80 is then moved downwardly into the position shown in FIG. 8 such that the tongues 88 fit into the slots 64, 66 in the front member 22 of the frame 20. The recesses 94 defined between the base 90 and top portion 92 of the tongues 88, engage the sidewalls of the slots 64, 66 to secure the facing panel 80 to the frame 20 with the facing member 84 covering the front member 22 of the frame 20. The top member 98 of the facing panel 80 is received in the recesses 42 on the top of the ribs 36, 38 and 40 with the uppermost portion of ribs 38, 40 received in the recesses 104, 106 to fix the facing panel 80 on the block frame 20 and reinforce the rigidity of this assembly.

To form a course of the retaining wall, laterally adjacent blocks are interconnected as shown, for example, in FIGS. 15–17. If the total height of the retaining wall to be formed by a plurality of courses is to be over six feet, it is recommended that the end portions of extended lengths of grid-like sheet material 114 be positioned between adjacent blocks.

As mentioned, preferred as reinforcing sheet materials are integral structural geogrids made by the process of the '798 patent. While a high density polyethylene biaxial integral structural geogrid of the type sold by Tensar as its BX 1200 geogrid, is most desirable, the grid may be formed of other polymerics, including other polyolefins, or various polyamides, polyesters or even steel (welded wire) or fiberglass. Additionally, structural grids made by other techniques, including woven or knitted grid-like sheets such as disclosed in co-pending U.S. patent application Ser. Nos. 08/643,182 and 08/696,604 filed May 9, 1996 and Aug. 14, 1996, respectively, assigned to Tensar, the subject matter of each of which is incorporated herein in its entirety by reference, may be readily adapted for use as the grid element according to this invention.

Utilizing the uniaxial techniques of the '798 patent, a multiplicity of molecularly-oriented elongated strands and transversely extending bars which are substantially unoriented or less-oriented than the strands are formed. The strands and bars together define a multiplicity of grid openings. With biaxial stretching, the bars are also formed into oriented strands. Regardless of the nature of the grid-like sheet of materials 114, the grid-connecting fingers 68*a*, 68*b*, 70*a*, 70*b* are spaced apart laterally equal to a multiple of the spacing between longitudinally extending strands 116 and are spaced apart longitudinally equal to a multiple of the spacing between the transversely extending strands 118. Not every grid opening need be engaged by one of the wall block fingers. Regardless of the spacing, transverse strands 118 in the end portions of the grid-like sheets 114 are engaged in the recesses 120 formed by the fingers 68*a*, 68*b*, 70*a*, 70*b*.

The strips of grid-like sheet material may be located between each course, i.e., between courses 124 and 126 and between courses 126 and 128, or only between selected courses or selected blocks 122*a*, 122*b*, 122*c* . . . , 124*a*, 124*b*, 124*c* . . . , and 126*a*, 126*b*, . . . , of a given course. See, for example, FIG. 13. The blocks are laterally joined as shown in FIG. 15. The length of the section 114 of grid-like sheet material may measure anywhere from, for example, 4 to 25 feet in length, and it is possible, at reduced heights, to eliminate the reinforcing material entirely, relying on the strike-through of the fill material through the openings in the bottom member 24 of each wall block frame 26 to hold a plurality of courses of wall blocks in place.

For vertically stacking successive courses of wall blocks according to this invention, downwardly and forwardly extending hook members 128 are provided on the bottom members 24 of each wall block frame 20. The hook members 128 each include a post 130 and a finger portion 132 which extends substantially parallel to the bottom member 24. A recess 134 is formed between the upper surface of the finger portion 132 and the bottom surface 62 of bottom member 24.

The leading edges 136 of the posts 130 are arcuate as seen in FIG. 1. Once the facing panels 80 have been secured to the wall block frames 20, the assembled wall blocks can be interconnected laterally to form a first course, and further courses can be built thereon. The top member 98 of a facing panel 80 is received in recesses 134 of hook members 128 on juxtaposed, staggered, blocks in a superimposed course with the arcuate leading surface edges 136 of the posts 130 engaging the arcuate surfaces 108 on the trailing edges 110 of the top members 98 of the blocks below. If adjacent blocks in a course of blocks are angled with respect to one another to form concave or convex portions of a retaining wall, the opposed arcuate surfaces, 136, 108, are in point contact, minimizing interference between the courses.

Figure 12:
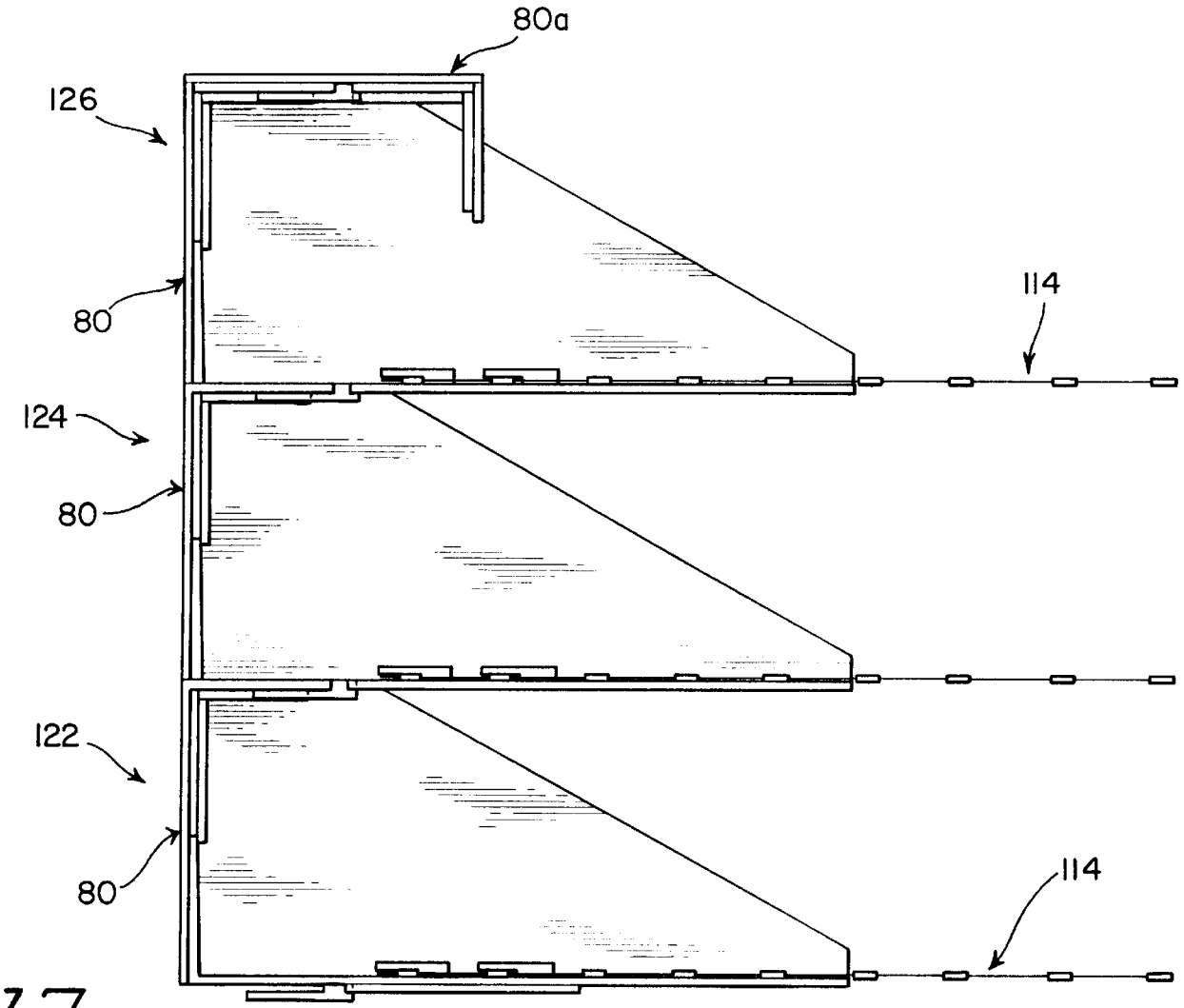
FIG. 12 is a side view of a retaining wall formed by a plurality of courses of wall blocks of the present invention with the front faces of the wall blocks vertically aligned between successive courses.
Figure 13:
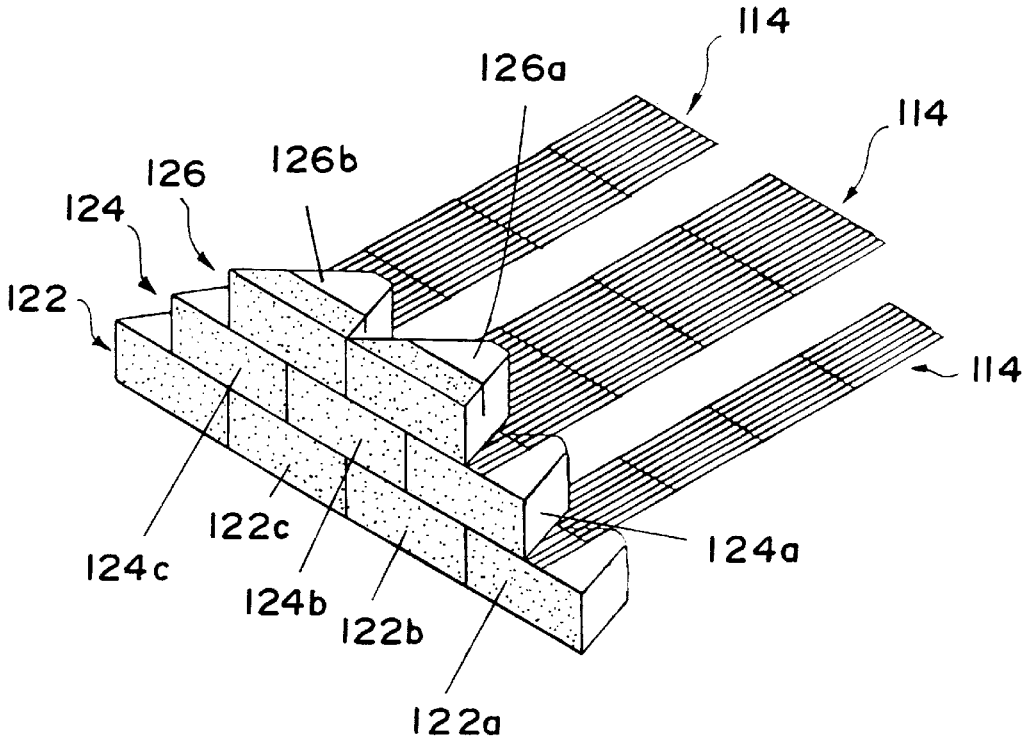
FIG. 13 is a schematic perspective view of a retaining wall formed of a plurality of courses of wall blocks according to this invention.

When the arcuate surfaces 136, 108 directly engage each other, the front faces 82 of facing panels 80 of successive courses of blocks are vertically aligned as shown in FIGS. 12 and 13. When it is desired to vertically offset or step back the faces of successive courses of blocks, spacing tabs 138 may be used. The spacing tabs 138, are formed integrally with the block frame 20, for example, in the openings 56 defined in the bottom member 24. The spacing tabs 138 are connected to the bottom member 24 by thin, frangible, bridging portions 140. By bending the spacing tabs 138 in and out of the plane of the bottom member 24, the bridging portions 140 will break to release the spacing tabs 138.

Figure 9:
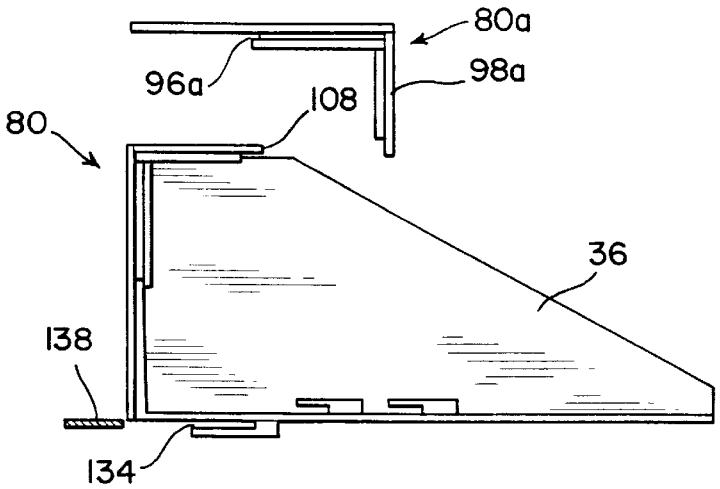
FIG. 9 is an exploded schematic view similar to FIG. 7 and including an additional facing panel repositioned for use as a cap unit.
Figure 10:
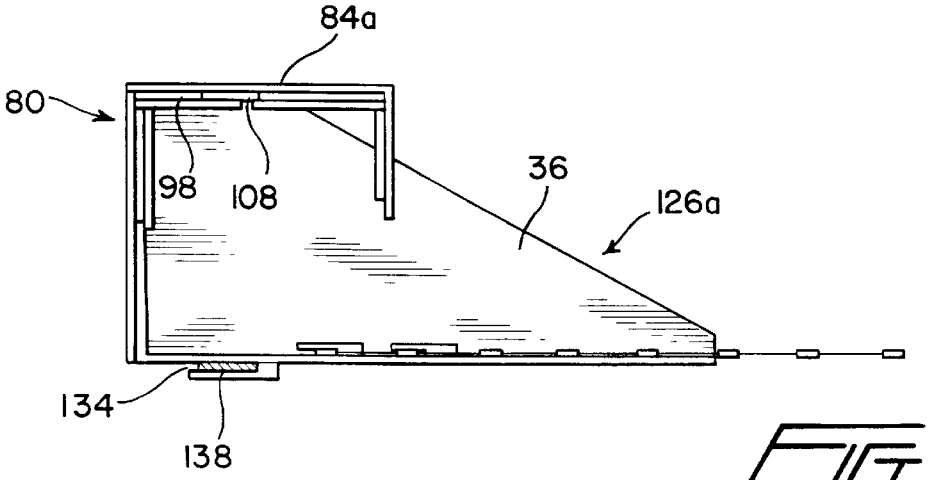
FIG. 10 is an assembled view of the components of FIG. 9 with a length of geogrid affixed thereto.
Figure 11:
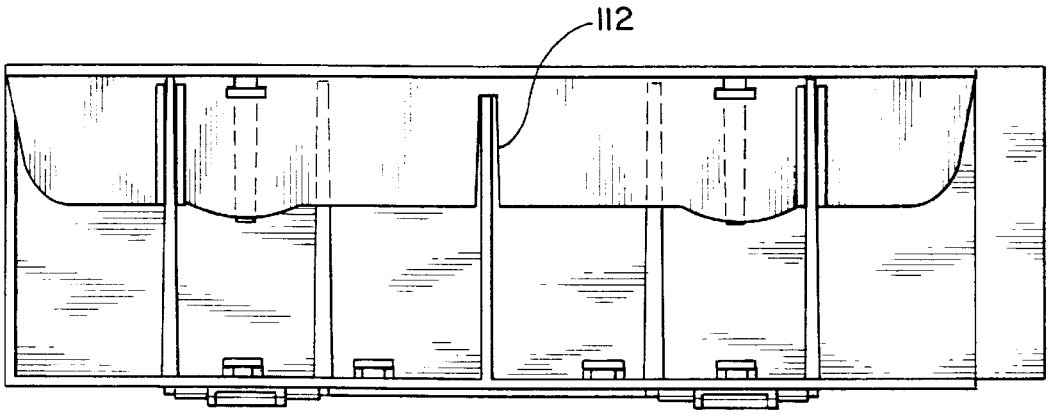
FIG. 11 is a rear view illustrating the incorporation of a cap on the wall block frame.
Figure 14:
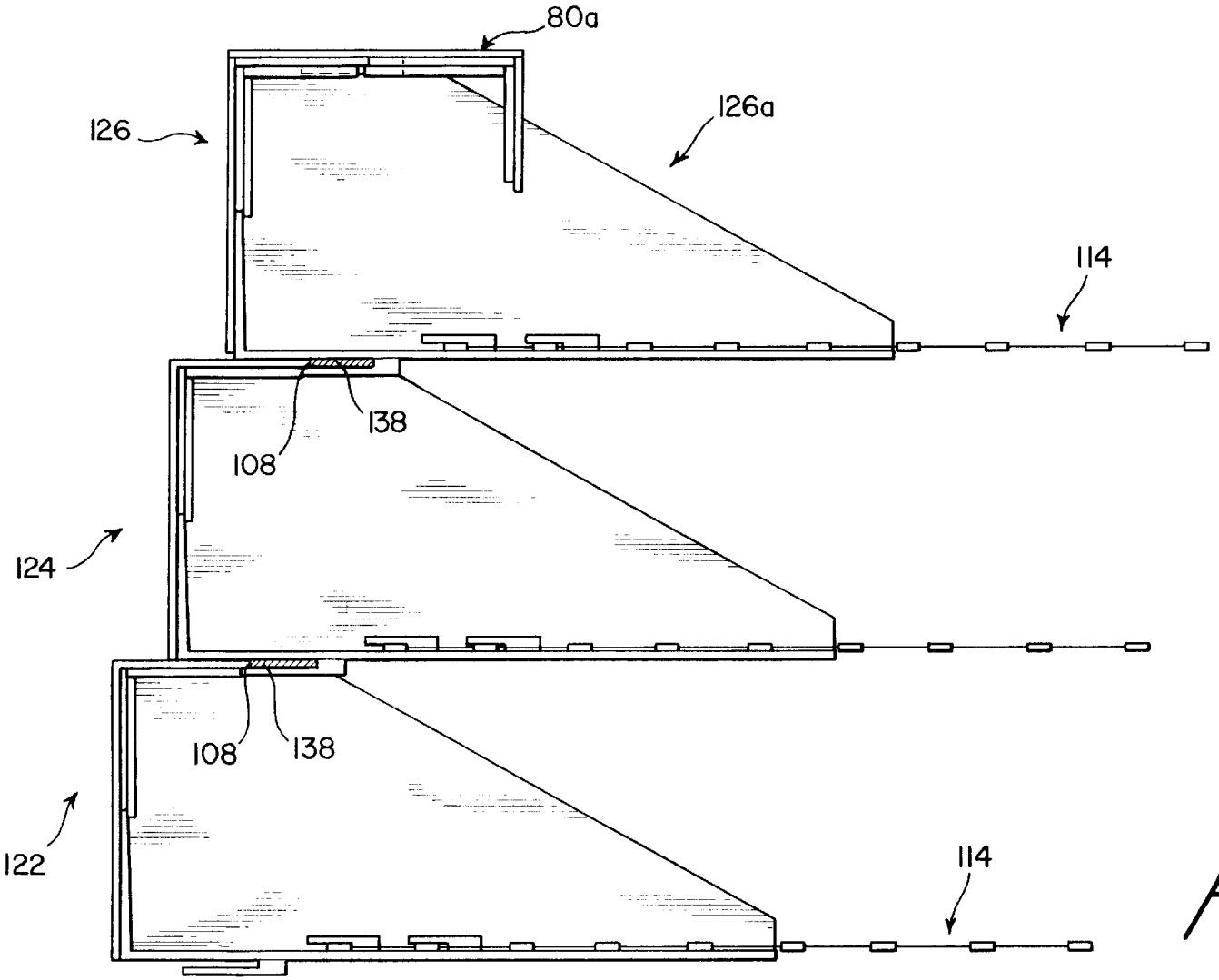
FIG. 14 is a view similar to FIG. 12 with the spacing tabs positioned to vertically offset the front faces of successive courses of wall blocks.

As shown in FIGS. 9, 10 and 14, by inserting the spacing tabs 138 into the recesses 134 formed by the hook members 128, the dimensional relationship between the hook members 128 and the top members 98 of superimposed wall blocks is adjusted to offset the front faces of successive courses by the depth of the spacing tabs. The arcuate surfaces 142 of the spacing tabs 138 are similar to the arcuate surfaces 136 of the posts 130 of the hook members 128 so as to engage the arcuate surfaces 136 on the top members 98, while wedging the spacing tab 138 in the recesses 134. Obviously, spacing tabs of different widths can be provided on each wall block frame (not shown) to allow the user to select the depth of the offset between the courses.

It is desirable to provide a cap unit which at least partially covers the blocks of the upper course in a retaining wall according to this invention without the need for a discrete element. Rotating a facing panel 80*a* by 90° as shown in FIG. 9, and moving the same downwardly and then forwardly until the arcuate surface 108 of a facing panel of a wall block in the upper course engages in the recess 96*a* formed between the base 90*a* and top portion 92*a* of the T-shaped tongue 88*a* enables a standard facing panel to be used as a cap unit as shown in FIG. 10. The cut-out or groove 112 in the top member straddles the rib 36 of the wall block frame 20 to stabilize the cap unit. See FIGS. 10, 12 and 14.

At a construction site, a plurality of plastic wall blocks are laterally interengaged to form an initial straight, angled or curved course. Selected grid-engaging fingers capture transverse strands or bars in the end portions of elongated lengths of grid-like sheet of material, the remainder of which is stretched out and interlocked with the fill soil or aggregate which is progressively back-filled as the courses are laid. The sheets of grid-like material may span a pair of wall blocks in a given course between their central ribs, at least in the production of a straight wall, and the grid-like material is embedded in earth which covers and interengages with the grid and the wall block frames to fix the course of blocks in position and creates a stable mass behind the retaining wall. Further courses of wall block are superimposed on the initial course, with the upper blocks laterally staggered with respect to the course below and interconnected by engagement of the hook members on the bottoms of the upper blocks with the top members of a pair of adjacent blocks below. Each course is covered with fill material in the same manner until the desired wall height has been reached. The final course may be provided with cap units in the manner described above.

The wall blocks of this invention may be of any size, for example, about 3 inches high and 12 inches wide at their front face, and 10 inches deep along their bottom members. For civil engineering purposes, more robust blocks may be provided. Similarly, the wall block may be formed of any suitable material. Desirable materials are polymers that may be structural foam molded, such as medium grade polypropylene. Such materials may be reinforced in a conventional way, i.e., by the addition of filler materials such as fiberglass of the like. A preferred block-forming material is a structural foam, that is, an injection molded engineering plastic, either preblended with a chemical blowing agent which, when heated, releases inert gas that disperses through the polymer melt, or into which an inert gas is introduced. When the gas/resin mixture is shot under pressure into the mold cavity, the gas expands within the plasticized material as it fills the mold, producing an internal cellular structure as well as a tough external skin at the mold face. Structural foams are well known and commercially available, for example, from General Electric as foamable grades of their LEXAN polycarbonate resins, NORYL thermoplastic resin and VALOX thermoplastic polyester resin. Further details of these resins and the structural foam process are found in *The Handbook of Engineering Structural Foam* published by General Electric, the subject matter of which is incorporated herein by reference. Alternative block-forming materials, foamed or otherwise, can be substituted therefor.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

We claim:

1. A wall block system to be used for forming a retaining wall including a plurality of wall blocks, each wall block comprising:

a wall block frame and a separate facing panel;

said wall block frame including a front member having front and rear surfaces and a top and a bottom, and a bottom member having upper and lower surfaces and extending generally perpendicularly from the bottom of said rear surface of said front member, said facing panel including a front member having front and rear surfaces and a top and a bottom, said front surface adapted to define part of the face of the retaining wall incorporating said wall block, and a top member having upper and lower surfaces and extending generally perpendicularly from the top of said rear surface of said front member, at least one groove extending from the top toward the bottom of said front member of said wall block frame;

at least one tongue extending from the rear surface of said front member of said facing panel dimensioned to be slidably received in said groove to secure said facing panel to said wall block frame with said front member of said facing panel overlying the front surface of said front member of said wall block frame, and said top member of said facing panel overlying the top of said front member of said wall block frame and extending generally parallel to said bottom member of said wall block frame, whereby when said wall block frame and said facing panel are secured together to form one of said plurality of wall blocks, said facing panels adapted to conceal said wall block frames in the retaining wall formed from a plurality of said wall blocks.

2. A wall block system according to claim 1 wherein said wall frame and said facing panel are formed of a plastic material.

3. A wall block system according to claim 2 wherein said bottom member of said wall block frame defines a series of through openings to minimize the use of plastic material, lighten the wall block and adapted to permit strike-through of aggregate fill material behind the wall block.

4. A wall block system according to claim 1 wherein said front member of said wall block frame includes at least two laterally spaced grooves, and a complementary number of tongues on said rear surface of said front member of said facing panel for slidable reception in said grooves.

5. A wall block system according to claim 1 further including a central reinforcing rib extending perpendicularly between said rear surface of front member and said upper surface of said bottom member of said wall block frame to rigidify said wall block.

6. A wall block system according to claim 5 including a further rib extending perpendicularly between said rear surface of said front member and said upper surface of said bottom member of said wall block frame on each side of said central rib, and recesses defined on the lower surface of said top member of said facing panel for engaging at least one of said ribs to further secure said wall block frame and facing panel to each other.

7. A wall block system according to claim 1 further including a plurality of finger members extending toward said front member above said upper surface of said bottom member of said wall block frame, said finger members being spaced apart a multiple of the spacing between apertures defined in end portions of a sheet of tieback material to be selectively used for reinforcing aggregate fill material behind the retaining wall.

8. A wall block system according to claim 1 to be used for forming the retaining wall including a plurality of vertically superimposed courses, each course including a plurality of laterally juxtaposed wall blocks, wherein each of said wall blocks includes at least one hook member extending toward said front member below said lower surfaces of said bottom member of said wall block frame, each hook member including a post having a front surface, said post supporting a forwardly extending finger member, a recess defined between said finger member and said lower surface of said bottom member, trailing end portions of said top member of the facing panel being engageable in said recesses to secure the wall blocks in superimposed courses to each other.

9. A wall block system according to claim 8 wherein said posts and said trailing end portions of said top member define convexly curved arcuate surfaces which engage each other at point contacts when the wall blocks in superimposed courses are secured to each other.

10. A wall block system according to claim 8 wherein the distance between said front surface of said post and the front surface of the facing panel of the wall block in an underlying course is such that the front surfaces of superimposed wall blocks are adapted to be vertically aligned to form a generally continuous face on the retaining wall.

11. A wall block system according to claim 10 further including at least one removably attached spacing member carried by said wall block frame, said spacing member being engageable in a respective recesses to shorten the depth of said recess whereby, with said spacing members in place, said front surfaces of overlying wall blocks are adapted to be offset rearwardly from said front surfaces of wall blocks therebelow to form a stepped-back face on the retaining wall.

12. A wall block system according to claim 9 further including opposed sidewalls on each wall block, one of said sidewalls of a wall block in a course of a retaining wall formed from said wall blocks being engageable with the other of said sidewalls of a laterally juxtaposed wall block such that the front surfaces of the facing panels of the juxtaposed wall blocks may selectively be (a) laterally aligned to form a straight portion of the face of the retaining wall, (b) offset at an acute angle to form a concave portion of the face of the retaining wall, or (c) offset at an obtuse angle to form a convex portion of the face of the retaining wall, while maintaining contact of the adjacent facing members without gaps formed therebetween in any of the selected orientations.

13. A wall block system according to claim 12 wherein each of said opposed sidewalls extends inwardly and rearwardly from said rear surface of said front member of said wall block frame to form an acute angle with said rear surface of said front member of said wall block frame, an arcuate lip extending outwardly from the distal end of one of the sidewalls adapted to receive the distal end of the other of said sidewalls in a laterally juxtaposed wall block.

14. A wall block system according to claim 13 further including a forwardly extending flange on the end of said arcuate lip adapted to limit the angular adjustment between the juxtaposed wall block.

15. A wall block system according to claim 1 further including additional facing panels adapted to be used as cap units to at least partially conceal the top of the uppermost course of the wall the blocks in the retaining wall with the front member of such facing panel cap unit adapted to extend generally parallel to the bottom members of an associated wall block frame and the top member of such facing panel cap unit extending downwardly in spaced relation to the front member of the wall block frame, said wall block frame including at least one rib member extending perpendicularly between said rear surface of said front member and said upper surface of said bottom member, said rib member including an upper portion adapted to underly and support one of said facing panel cap units.

16. A wall block system according to claim 15 including recessed portions defined in said rib member and dimensioned to receive said front member of an overlying facing panel cap unit.

17. A wall block system according to claim 15, further including a slot defined in said top member of an additional facing panel adapted to overly a rib member when said additional facing panel is used as a cap unit.

18. A wall block comprising a wall block frame and a facing panel according to claim 1 wherein said facing panel is secured to said wall block frame.

19. A retaining wall comprising a plurality of superimposed courses, each course including a plurality of wall blocks according to claim 18, wherein the wall blocks are laterally juxtaposed within each course.

20. A retaining wall according to claim 19 wherein said wall blocks in each course are laterally staggered by about one-half the width of one of said wall blocks with respect to the wall blocks in a course below.

21. A wall block to be used for forming a retaining wall including a plurality of vertically superimposed courses, each course including a plurality of laterally juxtaposed wall blocks, said wall block comprising:

a front member having front and rear surfaces and a top and a bottom, said front surface defining part of a face of a retaining wall incorporating said wall block, a bottom member having upper and lower surfaces and extending generally perpendicularly from the bottom of said rear surface of said front member, and a top member having upper and lower surfaces and extending generally perpendicularly from the top of said rear surface of said front member, at least one hook member extending toward said front member below said lower surface of said bottom member, each hook member including a post having a front surface, said post supporting a forwardly extending finger member, a recess defined between said finger member and said lower surface of said bottom member, trailing end portions of said top member being engageable in said recesses for securing the wall blocks in superimposed courses to each other, the distance between said front surface of said post and the front surface of a wall block in an underlying course being such that the front surfaces of superimposed wall blocks are adapted to be vertically aligned to form a generally continuous face on the retaining wall, at least one removably attached spacing member carried by said wall block, said at least one spacing member being engageable in a respective recess to shorten the depth of said recess whereby, with said spacing members in place, said front surfaces of overlying wall blocks are adapted to be offset rearwardly from said front surfaces of wall blocks therebelow to form a stepped-back face on the retaining wall.

22. A wall block according to claim 21 wherein said posts and said trailing end portions of said top member define convexly curved arcuate surfaces which engage each other at point contacts when the wall blocks in superimposed courses are secured to each other, and said spacing members have arcuate front and rear surfaces complementary to said arcuate surface on said posts to maintain the point contacts when said spacing members are engaged in said recesses.

23. A wall block according to claim 22 further including opposed sidewalls on said wall block, one of said sidewalls of said wall block adapted to be engageable with the other said side wall of a laterally juxtaposed wall block such that the front surfaces of the juxtaposed wall blocks may selectively be (a) laterally aligned to form a straight portion of the face of the retaining wall, (b) offset at an acute angle to form a concave portion of the face of the retaining wall, or (c) offset at an obtuse angle to form a convex portion of the face of the retaining wall, while maintaining contact of the adjacent facing members without gaps formed therebetween in any of the selected orientations.

24. A wall block system according to claim 23 wherein each of said opposed sidewalls extends inwardly and rearwardly from said rear surface of said front member to form an acute angle with said rear surface of said front member, an arcuate lip extending outwardly from the distal end of one of the sidewalls adapted to receive the distal end of the other sidewall in a laterally juxtaposed wall block.

25. A wall block according to claim 24 further including a forwardly extending flange on the end of said arcuate lip adapted to limit the angular adjustment between the juxtaposed wall blocks.

26. A wall block according to claim 21 wherein said wall block is formed of a plastic material.

27. A wall block according to claim 26 wherein said bottom of said wall block defines a series of through openings to minimize the use of plastic material, lighten the wall block and adapted to permit strike-through of aggregate fill material behind the wall block.

28. A wall block according to claim 27 wherein said spacing members are located in selected openings in said bottom member and secured to the material of said bottom member by thin, frangible, connecting members.

29. A wall block according to claim 21 further including a plurality of finger members extending toward said front member above said upper surface of said bottom member, said finger members being spaced apart a multiple of the spacing between apertures defined in end portions of a sheet of tieback material to be selectively used to reinforce aggregate fill material behind the wall block.

30. A retaining wall comprising a plurality of superimposed courses, each course including a plurality of wall blocks according to claim 21, wherein the wall blocks are laterally juxtaposed within each course.

31. A retaining wall according to claim 30 wherein said wall blocks in each course are laterally staggered by about one-half the width of one of said wall blocks with respect to the wall blocks in a course below.

32. A wall block to be used for forming a retaining wall including a course of laterally juxtaposed wall blocks, said wall block comprising:

a front member having front and rear surfaces and a top and a bottom, said front surface defining a part of a face of a retaining wall incorporating said wall block, a bottom member having upper and lower surfaces and extending generally perpendicularly from the bottom of said rear surface of said front member, a top member having upper and lower surfaces and extending generally perpendicularly from the top of said rear surface of said front member, and opposed sidewalls, one of said sidewalls of said wall block adapted to be engageable with the other sidewall of a laterally juxtaposed wall block such that the front surfaces of the juxtaposed wall blocks may selectively be (a) laterally aligned to form a straight portion of the face of the retaining wall, (b) offset at an acute angle to form a concave portion of the face of the retaining wall, or (c) offset at an obtuse angle to form a convex portion of the face of the retaining wall, while maintaining contact of the adjacent facing members without gaps formed therebetween in any of the selected orientations.

33. A wall block according to claim 32 wherein each of said opposed sidewalls extends inwardly and rearwardly from said rear surface of said front member of said wall block frame to form an acute angle with said rear surface of said front member of said wall block frame, an arcuate lip extending outwardly from the distal end of one of the sidewalls adapted to receive the distal end of the other sidewall in the laterally juxtaposed wall block.

34. A wall block according to claim 33 further including a forwardly extending flange on the end of said arcuate lip adapted to limit the angular adjustment between juxtaposed wall blocks.

35. A wall block according to claim 32 for forming the retaining wall including a plurality of superimposed courses, wherein said wall block includes at least one hook member extending toward said front member below said lower surface of said bottom member, each hook member including a post having a front surface, said post supporting a forwardly extending finger member, a recess defined between said finger member and said lower surface of said bottom member, trailing end portions of said top member of said wall block being engageable in said recesses for securing the wall blocks in superimposed courses to each other.

36. A wall block according to claim 35 wherein said posts and said trailing end portions of said top member define convexly curved arcuate surfaces which engage each other at point contacts when the wall blocks in superimposed courses are secured to each other.

37. A wall block according to claim 36 wherein the distance between said front surfaces of said posts and the front surface of the wall block is such that the front surfaces of superimposed wall blocks are vertically aligned to form a generally continuous face on the retaining wall.

38. A wall block according to claim 37 further including at least one removably attached spacing member carried by said wall block frame, said at least one spacing member being engageable in said recesses to shorten the depth of said recesses whereby, with said spacing members in place, said front surfaces of overlying wall blocks are offset rearwardly from said front surfaces of wall blocks therebelow to form a stepped-back face on the retaining wall.

39. A wall block according to claim 32 wherein said wall block is formed of a plastic material.

40. A wall block according to claim 39 wherein said bottom member of said wall block frame defines a series of through openings to minimize the use of plastic material, lighten the wall block and adapted to permit strike-through of aggregate fill material behind the retaining wall.

41. A wall block according to claim 32 further including a plurality of finger members extending toward said front member above said upper surface of said bottom member, said finger members being spaced apart a multiple of the spacing between apertures defined in end portions of a of tieback material.

42. A retaining wall comprising a plurality of superimposed courses, each course including a plurality of wall blocks according to claim 32, wherein the wall blocks are laterally juxtaposed within each course.

43. A retaining wall according to claim 42 wherein said wall blocks in each course are laterally staggered by about one-half the width of one of said wall blocks with respect to the wall blocks in a course below.

44. A wall block system to be used for forming a retaining wall including a plurality of wall blocks, each wall block comprising:

a wall block frame and separate universal panel elements;

said wall block frame including a front member having front and rear surfaces and a top and a bottom, and a bottom member having upper and lower surfaces and extending generally perpendicularly from the bottom of said rear surface of said front member, at least one rib extending perpendicularly between said rear surface of said front member and said upper surface of said bottom member, said rib having an upper portion generally coplanar with said top of said front member, said panel elements each including a front member having front and rear surfaces and a top and a bottom, and a top member having upper and lower surfaces and extending generally perpendicularly from the top of said rear surface of said front member, said front surface of said front member of said panel element defining part of the front face of a retaining wall incorporating said wall block when said panel element is used as a facing panel for said wall block frame with said rear surface of said front member of said panel element juxtaposed to said front surface of said front member of said wall block frame, and said front surface of said front member of said panel element defining part of a top face for the wall blocks in the uppermost course of wall blocks in the retaining wall when said panel element is rotated by 90° and used as a cap unit with said front member of said panel element overlying and resting on said upper portion of said rib and said top member of said panel element extending downwardly in spaced relation to said front member of said wall block frame, at least one groove extending from the top toward the bottom of said front member of said wall block frame;

at least one tongue extending from the rear surface of said front member of said panel element dimensioned to be slidably received in said groove to selectively secure said panel element to said wall block frame with said front member of said panel element overlying the front surface of said front member of said wall block frame and said top member of said panel element overlying the top of said front member of said wall block frame and extending generally parallel to said bottom member of said wall block frame, whereby, when said panel element is used as a facing panel and secured to said wall block frame to form a wall block, said facing panel conceals said wall block frame in a retaining wall formed from a plurality of said wall blocks, and a slot defined in said top member of said panel element adapted to overly said rib of a wall block frame in an uppermost course of wall blocks of the retaining wall when said panel element is used as a cap unit.

45. A wall block system according to claim 44 including recessed portions defined in said upper portion of said rib dimensioned to receive said front member of an overlying panel element used as a cap unit.

46. A wall block system according to claim 44 wherein said front member of said wall block frame includes at least two laterally spaced grooves, and a complementary number of tongues on said rear surface of said front member of said panel element for slidable reception in said grooves.

47. A wall block system according to claim 44 wherein each said tongue includes a stem and a cross bar extending beyond said stem on three sides to define a pair of side recesses and an end recess.

48. A wall block system according to claim 47 wherein, when said panel element is used as a facing panel, said side recesses engage sidewalls of said groove in an associated wall block frame and, when said panel element is used as a cap unit, said end recess engages a trailing edge of the top member of a panel element mounted on a wall block frame of an associated wall block in an uppermost course of the retaining wall.

49. A wall block system according to claim 44 wherein said wall block frame and said facing panels are formed of a plastic material.

50. A wall block system according to claim 49 wherein said bottom of said wall block frame defines a series of through openings to minimize the use of plastic material, lighten the wall block and adapted to permit strike-through of aggregate fill material behind the retaining wall.

51. A wall block system according to claim 44 further including a plurality of finger members extending toward said front member above said upper surface of said bottom member of said wall block frame, said finger members being spaced apart a multiple of the spacing between apertures defined in end portions of a of tieback material to be selectively used for reinforcing aggregate fill material behind the retaining wall.

52. A retaining wall comprising a plurality of superimposed courses, each course including a plurality of laterally juxtaposed wall blocks wherein said panel elements are secured to said wall block frames to form facing panels therefor, and the uppermost course of wall blocks are at least partially covered by panel elements rotated according to claim 44 to define cap units therefor.

* * * * *